US009551493B2

(12) United States Patent
Lee et al.

(10) Patent No.: US 9,551,493 B2
(45) Date of Patent: Jan. 24, 2017

(54) OVEN

(71) Applicant: SAMSUNG ELECTRONICS CO., LTD., Suwon (KR)

(72) Inventors: Dong Ho Lee, Suwon (KR); Eun Oh Kim, Seoul (KR); Cheol Jin Kim, Suwon (KR); Guen Yong Park, Hwaseong (KR); Nam Soo Park, Suwon (KR); Ho Yeun Lee, Suwon (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 516 days.

(21) Appl. No.: 13/946,342

(22) Filed: Jul. 19, 2013

(65) Prior Publication Data

US 2014/0020670 A1 Jan. 23, 2014

(30) Foreign Application Priority Data

Jul. 20, 2012 (KR) ..... 10-2012-0079450

(51) Int. Cl.

| | |
|---|---|
| ***F24C 15/32*** | (2006.01) |
| ***F24C 15/20*** | (2006.01) |
| ***F24C 7/08*** | (2006.01) |
| ***F24C 15/00*** | (2006.01) |

(52) U.S. Cl.

CPC ..... *F24C 15/2007* (2013.01); *F24C 7/085* (2013.01); *F24C 15/006* (2013.01); *F24C 15/322* (2013.01)

(58) Field of Classification Search

CPC .... F24C 15/2007; F24C 15/006; F24C 15/322
USPC ..... 126/21 A, 273 R
See application file for complete search history.

(56) References Cited

U.S. PATENT DOCUMENTS 4,601,279 A * 7/1986 Guerin ..... F24C 14/02 126/21 A
2003/0213372 A1 11/2003 Lappat et al.
2008/0110879 A1* 5/2008 Marchand ..... F24C 15/2007 219/757

FOREIGN PATENT DOCUMENTS

| | | | |
|---|---|---|---|
| DE | 2309873 A1 * | 8/1974 | ..... F24C 14/02 |
| DE | 4211755 | 10/1993 | |
| DE | 10240145 | 3/2004 | |
| EP | 1028290 | 8/2000 | |
| EP | 1867929 | 12/2007 | |

(Continued)

OTHER PUBLICATIONS

Extended European Search Report dated Dec. 23, 2014 in European patent Application No. 13176928.3, 8 pages.

(Continued)

*Primary Examiner* — Jorge Pereiro
(74) *Attorney, Agent, or Firm* — Staas & Halsey LLP

(57) ABSTRACT

An over having an improved exhaust structure capable of discharging a fluid of the inside of a cooking chamber at a constant rate, the oven including a cooking chamber cooking food, a machine chamber disposed at an upper side of the cooking chamber and accommodating an electronic component, a cooling fan unit disposed at an inside of the machine chamber to cool the machine chamber, and a flow passage guide communicating with an inside the cooking chamber and an inside of the cooling fan unit such that a fluid of the inside of the cooking chamber is introduced to the inside of the cooling fan unit, wherein the cooling fan unit includes a cooling fan configured to suck a fluid of the inside the machine chamber and blow the fluid to the outside environment.

15 Claims, 9 Drawing Sheets

(56) References Cited

FOREIGN PATENT DOCUMENTS

| | | | | | |
|---|---|---|---|---|---|
| EP | 2072903 | | | 6/2009 | |
| FR | 2688297 | | | 9/1993 | |
| FR | 2906872 | A1 | * | 4/2008 | ..... F24C 15/006 |
| GB | 1459472 | | * | 12/1976 | |
| SI | EP 2072903 | A2 | * | 6/2009 | ..... F24C 15/006 |
| WO | WO 2011/080100 | A2 | | 7/2011 | |
| WO | WO 2011/080100 | A3 | | 7/2011 | |
| WO | WO 2012/025869 | A1 | | 3/2012 | |
| WO | WO 2012/117378 | A1 | | 9/2012 | |

OTHER PUBLICATIONS

European Office Action mailed Aug. 19, 2016 in corresponding European Application No. 13 176 928.3.

* cited by examiner

OVEN

CROSS-REFERENCE TO RELATED APPLICATIONS

This application claims the benefit of Korean Patent Application No. 10-2012-0079450, filed on Jul. 20, 2012 in the Korean Intellectual Property Office, the disclosure of which is incorporated herein by reference.

BACKGROUND

1. Field

Embodiments of the present disclosure relate to an oven having a structure for discharging fluid of inside of a cooking chamber.

2. Description of the Related Art

An oven is a machine designed to cook foodstuff by use of a heating source, and includes a cooking chamber in which food is cooked and a machine chamber to accommodate electronic parts. In a process of cooking food, the inside of the cooking chamber is sealed to prevent high-temperature heat from leaking to the outside.

An oven is provided with an exhaust apparatus configured to exhaust fluid of the inside of the cooking chamber to adjust the internal pressure or humidity as a result of maintaining a high temperature in the cooking chamber, and to remove various gas or odor being generated during a process of cooking food.

In a case of an exhaust apparatus having a structure capable of exhausting fluid of the inside of the cooking chamber by use of the Venturi effect, the amount of fluid being discharged through an outlet from the inside of the cooking chamber may significantly vary depending on the size and position of the outlet set to generate the Venturi effect. If the amount of fluid being discharged through the outlet significantly varies, for example, the amount of fluid being discharged through the outlet is excessively small, almost no exhaust effect is attained, and if the amount of fluid being discharged through the outlet is excessively large, the cooking performance is degraded.

SUMMARY

Therefore, it is an aspect of the present disclosure to provide an oven having an improved exhaust structure capable of discharge a fluid of the inside of a cooking chamber at a constant rate.

Additional aspects will be set forth in part in the description which follows and, in part, will be apparent from the description, or may be learned by practice of the disclosure.

In accordance with one aspect, an oven includes a cooking chamber, a machine chamber, a cooling fan unit and a flow passage guide. The cooking chamber may cook food. The machine chamber may be disposed at an upper side of the cooking chamber and accommodating an electronic component. The cooling fan unit may be disposed at an inside of the machine chamber to cool the machine chamber. The flow passage guide may communicate with an inside the cooking chamber and an inside of the cooling fan unit such that a fluid of the inside of the cooking chamber is introduced to the inside of the cooling fan unit. The cooling fan unit may include a cooling fan, a first outlet, a second outlet, and a flow control hole. The cooling fan may be configured to suck a fluid of the inside the machine chamber and blow the fluid. The first outlet may allow the fluid blown by the cooling fan to be discharged to an outside the cooling fan unit therethrough. The second outlet may allow a fluid passing through the fluid passage guide to be discharged to the inside of the cooling fan unit therethrough. The flow control hole may control a volume of the fluid discharged through the second outlet, by guiding the fluid of the inside of the cooling fan unit so as to be introduced to the fluid passage guide.

The fluid passage guide may include a first terminal, a second terminal and a third terminal. The first terminal may communicate with the cooking chamber. The second terminal may communicate with the second outlet. The third terminal may communicate with the flow control hole.

The flow passage guide may include a first flow passage, a third flow passage and a second flow passage. The first flow passage may allow a fluid introduced through the first terminal to flow there along. The third flow passage may allow a fluid introduced through the third terminal to flow there along. The second flow passage may allow a fluid introduced from the third flow passage to flow while joining a fluid introduced from the first flow passage there along.

The cooling fan unit may include an inclined surface formed by having at least one portion thereof inclined. The second outlet may be provided at one side of the inclined surface.

The second outlet may be formed by slitting one portion of the inclined surface.

The fluid being discharged through the second outlet may be discharged to the outside the cooling fan unit through the first outlet together with a fluid which is being introduced to the cooling fan unit by being blown by the cooling fan.

In accordance with one aspect, an oven may include a cooking chamber, a machine chamber, a housing, a cooling fan, a fluid passage guide and a plurality of communication holes. The cooking chamber may cook food. The machine chamber may accommodate an electronic component. The housing may be disposed an inside the machine chamber. The cooling fan may be coupled to one end of the housing to suck a fluid of an outside the housing and blow the sucked fluid to an inside of the housing. The fluid passage guide may be coupled to the cooking chamber and the housing. The plurality of communication holes may be formed through one surface of the housing such that the housing communicates with the fluid passage guide in at least two different positions. The plurality of communication holes may include a first communication hole and a second communication hole. The first communication hole may guide a fluid of an inside of the flow passage guide so as to be discharged to an inside of the housing. The second communication hole may guide a fluid of the inside of the housing so as to be introduced to the inside of the flow passage guide.

At least one outlet may be provided at other end of the housing to guide the fluid being introduced to the inside of the housing so as to be discharged to the outside the housing.

The housing may include a width decrease part and a parallel part. The width decrease part may have a width decreased in an upper and lower side direction. The parallel part may have a width maintained constant in an upper and lower side direction and may be provided at one end thereof with the outlet.

The first communication hole may be provided at the parallel part.

The second communication hole may be provided at the width decrease part.

The first communication hole may be formed by slitting one portion of the housing.

The flow passage guide may include a first flow passage, a third flow passage and a second flow passage. The first flow passage may allow a fluid introduced from the cooking chamber to flow there along. The third flow passage may allow a fluid introduced through the second communication hole to flow there along. The second flow passage may allow a fluid introduced from the third flow passage to flow while joining a fluid introduced from the first flow passage there along.

The flow flowing along the third fluid passage, after being introduced to the inside of the housing through the first communication hole, is discharged to the outside the housing through the outlet together with the fluid of the inside of the housing.

The outlet may be located between the cooking chamber and the machine chamber.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
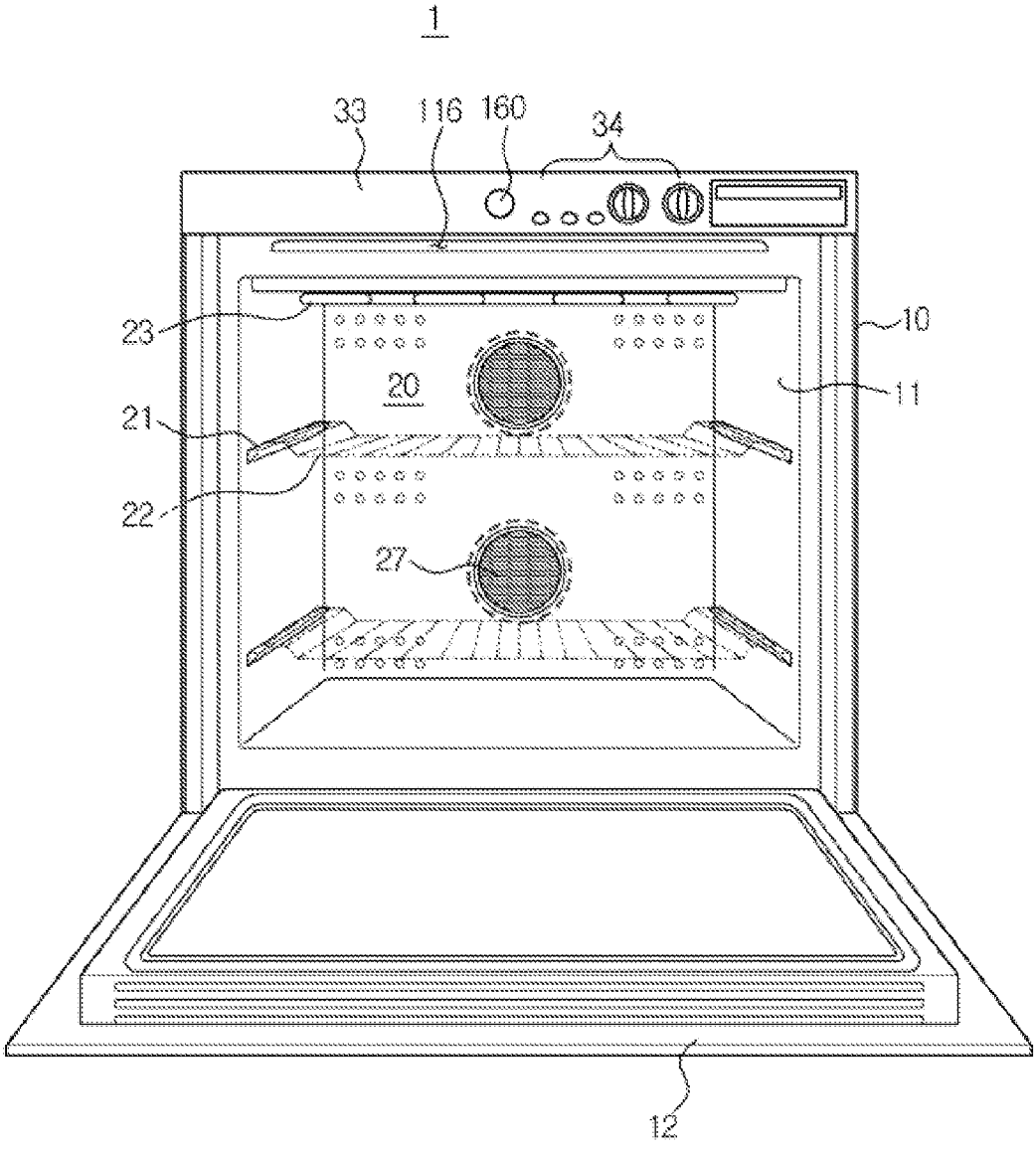
FIG. 1 is a view illustrating an oven in accordance with an embodiment.

Reference will now be made in detail to the embodiments, examples of which are illustrated in the accompanying drawings, wherein like reference numerals refer to like elements throughout.

Figure 2:
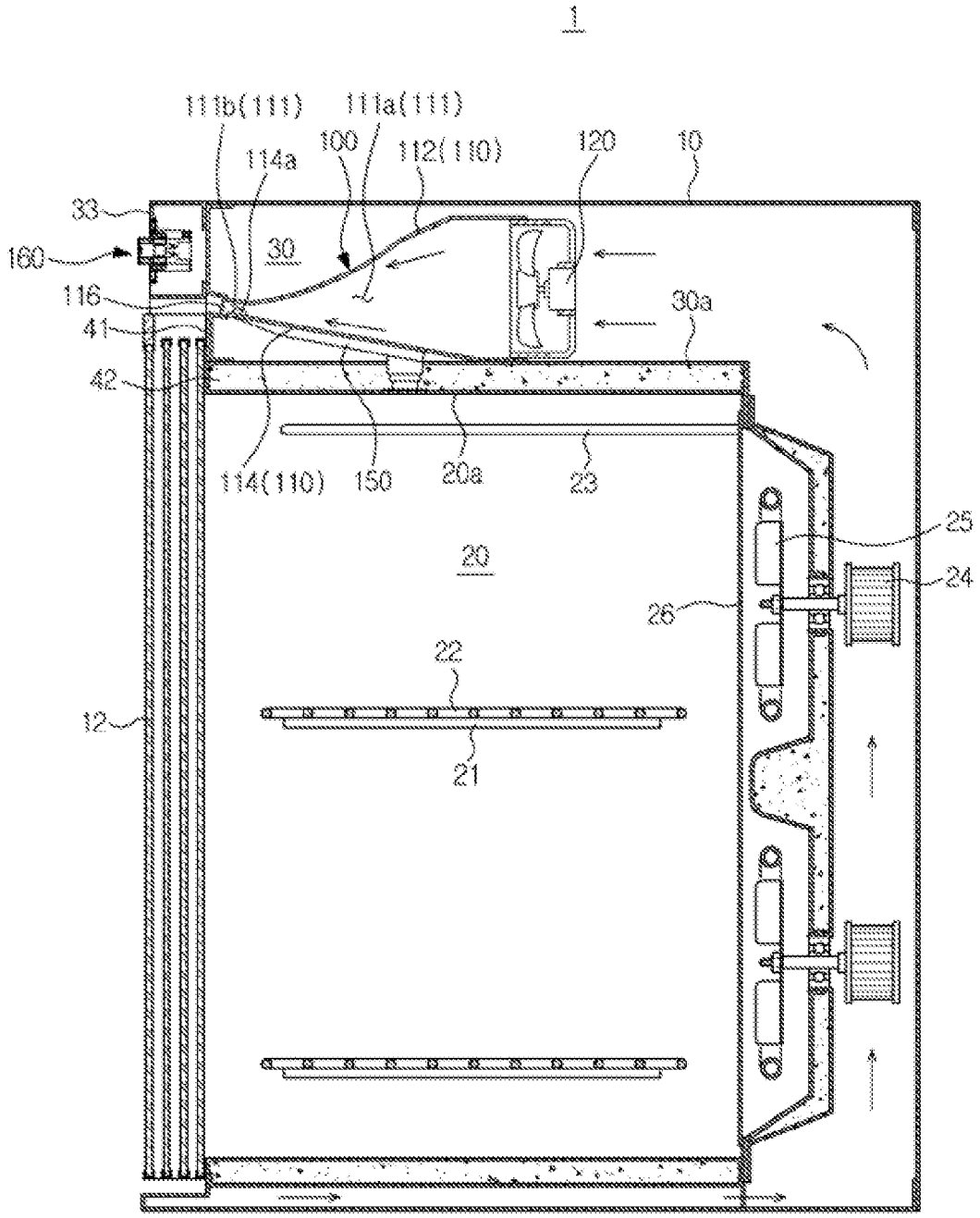
FIG. 2 is a side sectional view of an oven in accordance with an embodiment.

FIG. 1 is a view illustrating an oven in accordance with an embodiment, and FIG. 2 is a side sectional view of an oven in accordance with an embodiment.

Referring to FIGS. 1 and 2, the oven 1 includes an outer case 10 having a box shape, an inner case 11 accommodated in the outer case 10 and provided so as to be open at a front surface thereof, and a door 12 opening and closing the open front surface of the inner case 11.

A cooking chamber 20 cooking food is provided in the inner case 11. Guide rails 21 are provided at both sides of the cooking chamber 20, and a rack 22, on which foodstuff or a vessel containing food is placed, is detachably coupled to the guide rail 21. A heater 23 is installed at an upper side of the cooking chamber 20 to generate a heat for cooking the food on the rack 22. A circulation motor 24 and a circulation fan 25 are installed at a rear of the cooking chamber 20 to form uniform temperature at an inside the cooking chamber 20 by circulating the air of the inside of the cooking chamber 20 such that the food is rapidly cooked. A fan cover 26 formed of a plate-like member is coupled to a front side of the circulation fan 25. A through-hole part 27 is formed at the fan cover 26.

A machine chamber 30 in which various types of electronic components (not shown) are disposed is provided at an upper side of the cooking chamber 20. Buttons, a display part 34 and a pop-up apparatus 160 are provided at a front surface panel 33 forming the machine chamber 30 to adjust the cooking time or the cooking process.

A cooking fan unit 100 is installed at an inside of the machine chamber 30 to cool the temperature of the inside of the machine chamber 30. The cooling fan unit 100 sucks the outside air to the inside of the machine chamber 30, and discharges the air toward a front of the oven 1.

The cooking chamber 20 and the cooking fan unit 100 communicate with each other through a fluid passage guide 150. In a process of cooking food, at least one portion of a fluid of the inside of the cooking chamber 20 is introduced to the cooling fan unit 100 through the fluid passage guide 150, and then is discharged to the front of the oven 1.

A shielding frame 41 is provided between the cooking chamber 20 and the machine chamber 30 to prevent an interior between the cooking chamber 20 and the machine chamber 30 from being exposed to the outside, and an heat insulation material 42 is located in a space among the upper side of the cooking chamber 20, the lower side of the machine chamber 30 and the shielding frame 41. The heat insulation material 42 blocks heat of the inside of the cooking chamber 20 from being transferred to the inside of the machine chamber 30.

Hereinafter, the structure of the cooling fan unit 100 and a principle of discharging the fluid of the inside of the cooking chamber 20 will be described in detail.

Figure 3:
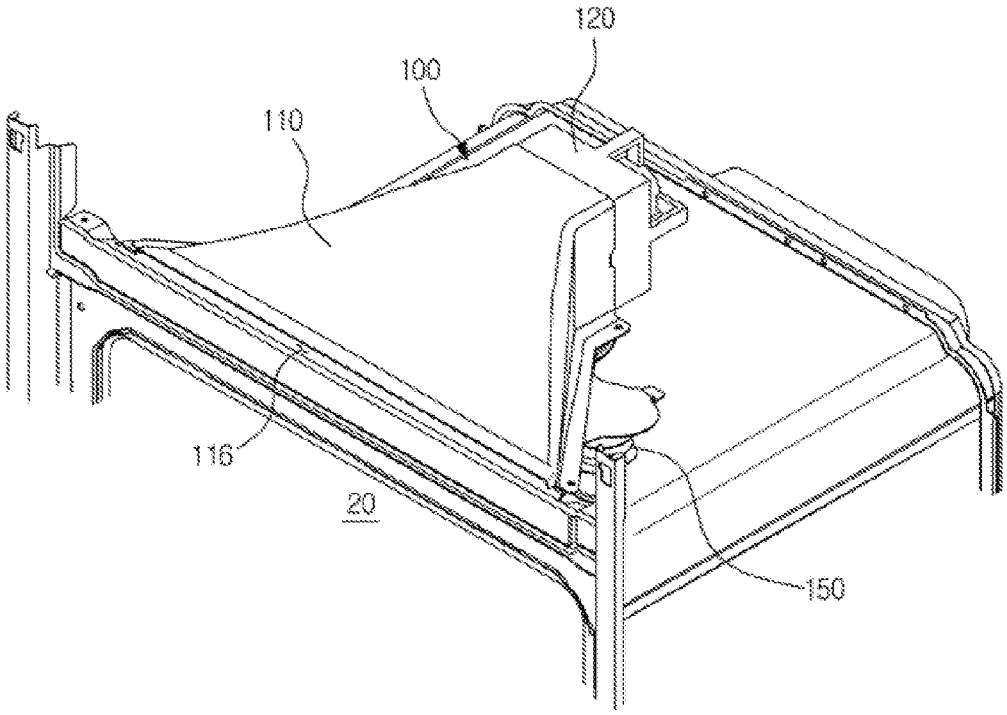
FIG. 3 is a perspective view illustrating main components of a cooling fan unit.
Figure 4:
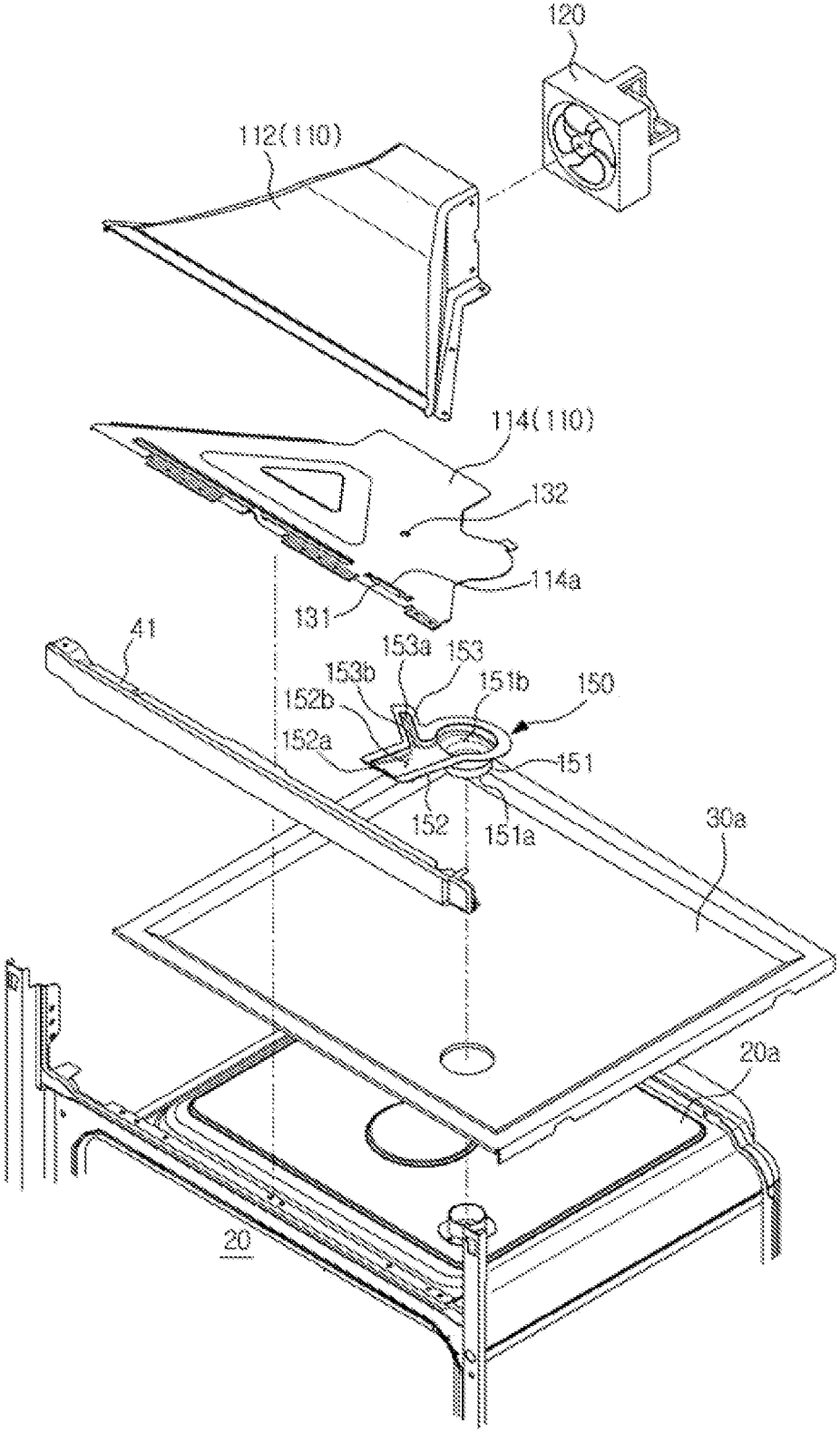
FIG. 4 is an exploded perspective view of FIG. 3.
Figure 5:
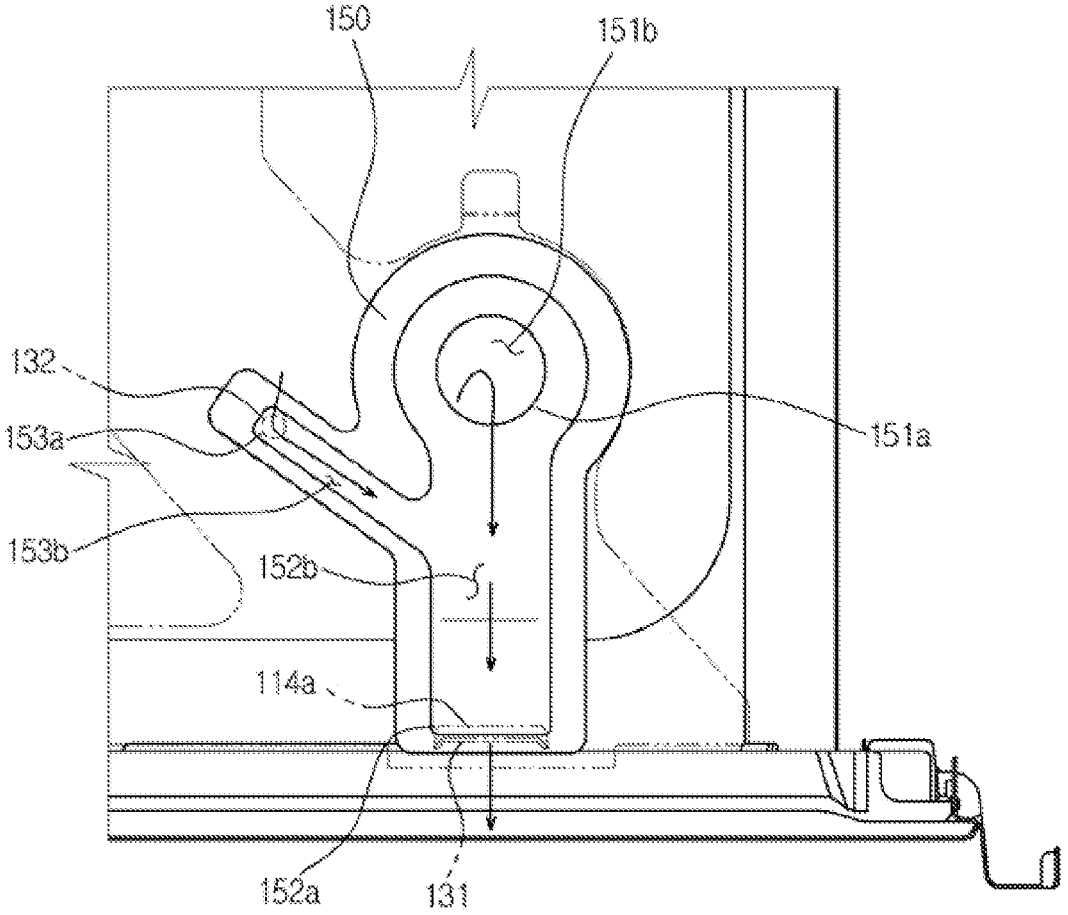
FIG. 5 is a view for explaining a principle of controlling the volume of a fluid being discharged through a second outlet.

FIG. 3 is a perspective view illustrating main components of a cooling fan unit, FIG. 4 is an exploded perspective view of FIG. 3 and FIG. 5 is a view for explaining a principle of controlling the volume of fluid being discharged through a second outlet.

Referring to FIGS. 2 to 5, the cooling fan unit 100 includes a housing 110 disposed at an inside the machine chamber 30, and a cooling fan 120 coupled to one end of the housing 110 to suck a fluid of an outside of the housing 110 and blow the sucked fluid to the inside the housing 110.

The housing 110 is composed by including an upper bracket 112 and a lower bracket 114 coupled one on top of another to from a space in which a fluid flows. The upper bracket 112 and the lower bracket 114 are inclined in directions facing each other.

A first outlet 116 is formed at the other end of the housing 110 opposite to the one end of the housing, to which the cooling fan 120 is coupled, to discharge the fluid being introduced to the inside of the housing 110 to the outside of the housing 110. The first outlet 116 is located between the cooking chamber 20 and the machine chamber 30.

In addition, an interior space 111 of the housing 110 is composed by including a width decrease part 111*a* having an interval in an upper and lower side direction decreased between the upper bracket 112 and the lower bracket 114, and a parallel part 111*b* having an interval maintained substantially constant in an upper and lower side direction between the upper bracket 112 and the lower bracket 114. The first outlet 116 is formed at one end of the parallel part 111*b*.

The width decrease part 111*a* serves to produce the Venturi effect at the inside the housing 110. The fluid being sucked to the interior space 111 of the housing 110 by the cooling fan 120 is gradually accelerated while passing through the width decrease part 111*a*, and then discharged to the outside the housing 110 through the first outlet 116.

A plurality of communication holes 131 and 132 are formed at the lower bracket 114. The plurality of communication holes 131 and 132 includes a first communication hole 131 guiding the fluid of an inside of a fluid passage guide 150, which is described later, so as to be discharged to the interior space 111 of the housing 110, and a second communication hole 132 guiding the fluid flowing in the interior space 111 so as to be discharged to the inside the fluid passage guide 150. The first communication hole 131 is formed by slitting one portion of the lower bracket 114, and the second communication hole 132 is formed by perforating another portion of the lower bracket 114. In this case, one portion 114*a* of the lower bracket 114 bent to an inner side of the housing 110 by being slit to form the first communication hole 131 prevents the fluid of the inside of the housing 110 from flowing backward and thus being introduced to the inside of the fluid passage guide 150.

The first communication hole 131 may be formed at the parallel part 111*b*, and the second communication hole 132 may be formed at the width decrease part 111*a*. Since the first communication hole 131 is formed at the parallel part 111*b*, the volume of the fluid being discharged to the interior space 111 of the housing 110 through the first communication hole 131 is maintained within a predetermined range. That is, in a case in which the first communication hole 131 is located at the width decrease part 111*a*, the volume of the fluid being discharged through the first communication hole 131 may be significantly affected depending on the interval between the upper bracket 112 and the lower bracket 114 of a portion having the first communication hole 131. However, in a case in which the interval between the upper bracket 112 and the lower bracket 114 of a portion having the first communication hole 131 is constant, the volume of the fluid being discharged through the first communication hole 131 is maintained within a predetermined range.

The fluid passage guide 150 communicating the inside of the cooking chamber 20 and the inside of the housing 110 is coupled to a lower surface of the lower bracket 114.

The fluid passage guide 150 includes a first branch 151 passing through an upper frame 20*a* of the cooking chamber 20 and a lower frame 30*a* of the machine chamber 30, a second branch 152 connected to the first branch 151 and coupled to the lower surface of the lower bracket 114, and a third branch 153 connected to the second branch 152 and coupled to the lower surface of the lower bracket 114.

A first terminal 151*a* communicating with the inside of the cooking chamber 20 is provided at one end of the first branch 151, and the first branch 151 is provided at an inside thereof with a first fluid passage 151*b* along which a fluid being introduced through the first terminal 151*a* flows. A second terminal 152*a* communicating with the first communication hole 131 is provided at one end of the second branch 152, and the second branch 152 forms a second fluid passage 152*b*, along which a fluid being introduced through the first fluid passage 151*b* and a fluid being introduced through the third fluid passage 153*b* flow, in cooperation with the lower surface of the lower bracket 114. A third terminal 153*a* communicating with the second communication hole 132 is provided at one end of the third branch 153, and the third branch 153 forms a third fluid passage 153*b*, along which a fluid being introduced through the second communication hole 132 flows, in cooperation with the lower surface of the lower bracket 114.

The second terminal 152*a* communicating with the first communication hole 131 has a cross section smaller than a cross section of the first fluid passage 151*b*, and the second fluid passage 152*b* has a cross section decreased toward the second terminal 152*a*. According to the shape of the fluid passage guide 150, the Ventury effect occurs. The fluid being introduced to the fluid passage guide 150 from the inside of the cooking chamber 20 is gradually accelerated while passing through the first fluid passage 151*b* and the second fluid passage 152*b*, and discharged to the interior space 111 of the housing 110 through the first communication hole 131, and then discharged to the outside the housing 110 through the first outlet 116.

Some of the fluid being introduced to the interior space 111 of the housing 110 by the cooling fan 120 is introduced to the third fluid passage 153*b* through the second communication hole 132 and the third terminal 153*a*. The fluid being introduced to the third fluid passage 153*b* is introduced to the second fluid passage 152*b* by a pressure drop occurring due to the flow of fluid passing through the second fluid passage 152*b*, is discharged to the interior space 111 of the housing 110 through the first communication hole 131 together with the fluid passing through the second fluid passage 152*b*, and then discharged to the outside the housing 110 through the first outlet 116.

The fluid of the inside of the cooking chamber 20 being introduced through the first terminal 151*a* and the fluid of the inside of the housing 110 being introduced through the second communication hole 132 and the third terminal 153*a* are discharged to the interior space 111 of the housing 110 through the second terminal 152*a*. According to the equation of continuity of fluid, the sum of the volume of a fluid being introduced to the first terminal 151*a* among the fluid of the inside of the cooking chamber 20 and the volume of a fluid being introduced through the second communication hole 132 and the third terminal 153*a* among the fluid of the inside of the housing 110 is equal to the volume of a fluid being discharged to the interior space 111 of the housing 110 through the second terminal 152*a*. In addition, the volume of the fluid being discharged to the interior space 111 of the housing 110 through the second terminal 152*a* is maintained constant. Accordingly, if the volume of a fluid being introduced through the second communication hole 132 and the third terminal 153*a* among the fluid of the inside the housing 110 is increased, the volume of a fluid being introduced to the first terminal 151*a* among the fluid of the cooking chamber 20 is decreased. On the contrary, if the volume of a fluid being introduced through the second communication hole 132 and the third terminal 153*a* among the fluid of the inside the housing 110 is decreased, the volume of a fluid being introduced to the first terminal 151*a* among the fluid of the cooking chamber 20 is increased.

By using such a principle, the volume of a fluid being discharged to the outside of the cooking chamber 20 from the inside of the cooking chamber 20 is adjusted. That is, the volume of a fluid being discharged from the inside of the cooking chamber 20 to the outside of the cooking chamber 20 is equal to the volume of a fluid being introduced to the first terminal 151*a* among the fluid of the inside of the cooking chamber 10, and as described above, the volume of a fluid being introduced to the first terminal 151*a* among the fluid of the inside of the cooking chamber 20 varies with the volume of a fluid being introduced through the second communication hole 132 and the third terminal 153*a*. Since the volume of the fluid being introduced through the second communication hole 132 and the third terminal 153*a* substantially relates to a cross section of the second communication hole 132 or a formation position of the second communication hole 132 on the lower bracket 114, the volume of the fluid being discharged from the inside of the cooking chamber 20 to the outside of the cooking chamber 20 may be controlled by adjusting the cross section of the second communication hole 132 or the formation position of the second communication hole 132. In this regard, the second communication hole 132 may be regarded as a flow control hole.

As described above, the flow control hole 132 is provided to control the volume of a fluid being discharged from the inside of the cooking chamber 20 to the outside of the cooking chamber 20, thereby forming the interior of the cooking chamber 20 having an optimum cooking environment.

Hereinafter, the pop-up apparatus 160 provided at the front surface of the oven 1 will be described in detail.

Figure 6:
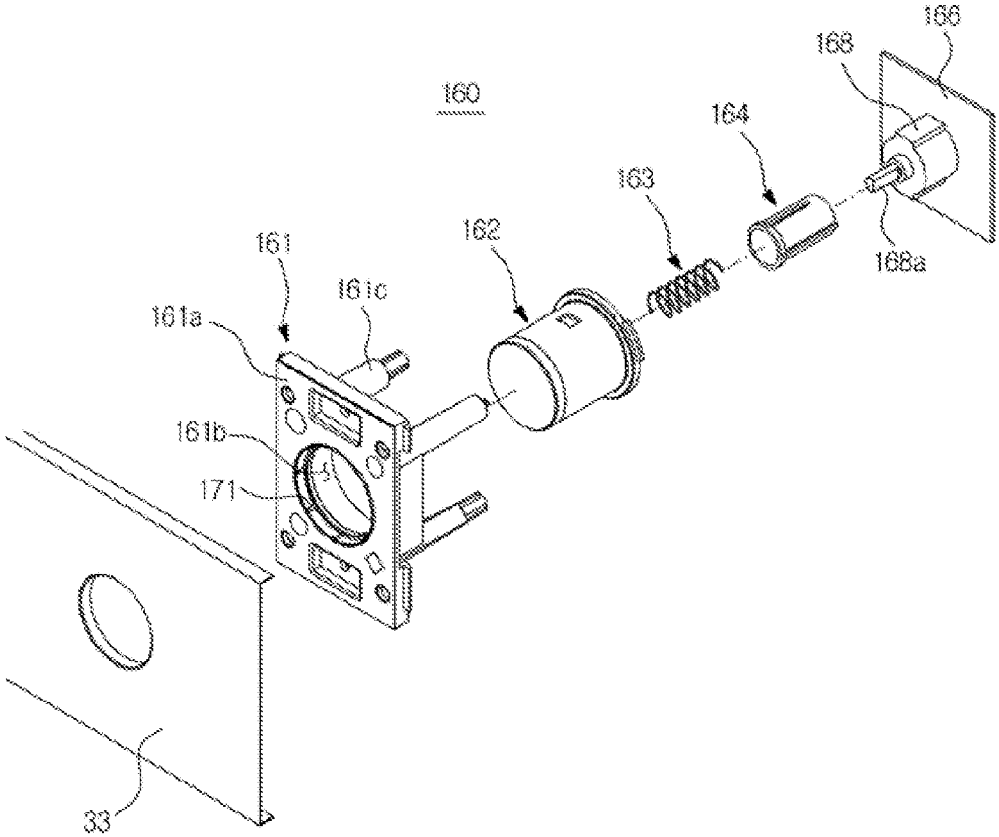
FIG. 6 is an exploded perspective view of a pop-up apparatus in accordance with an embodiment.
Figure 7A:
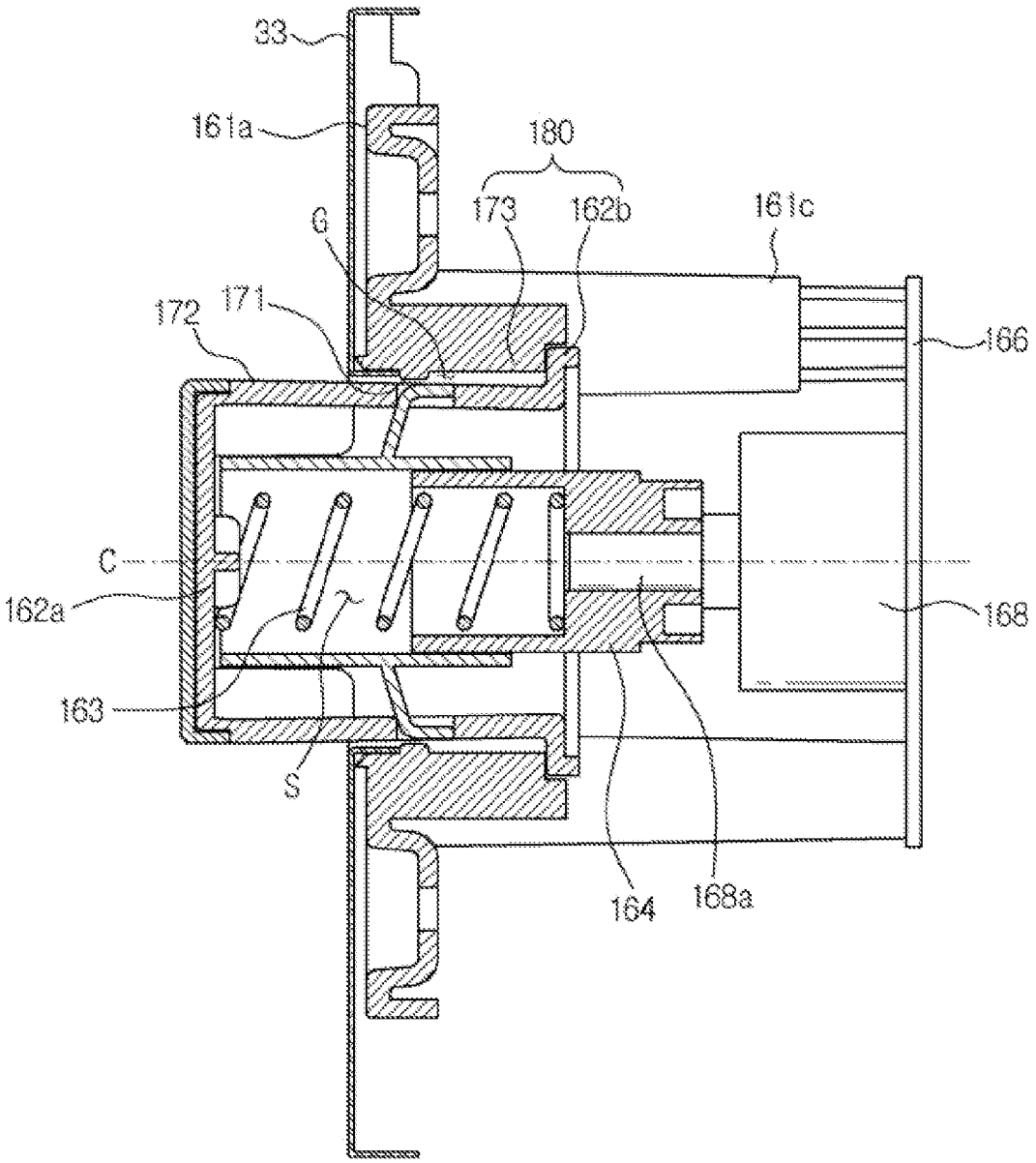
FIG. 7A is a cross sectional view of a pop-up apparatus in accordance with an embodiment, showing a knob disposed at a first position.
Figure 7B:
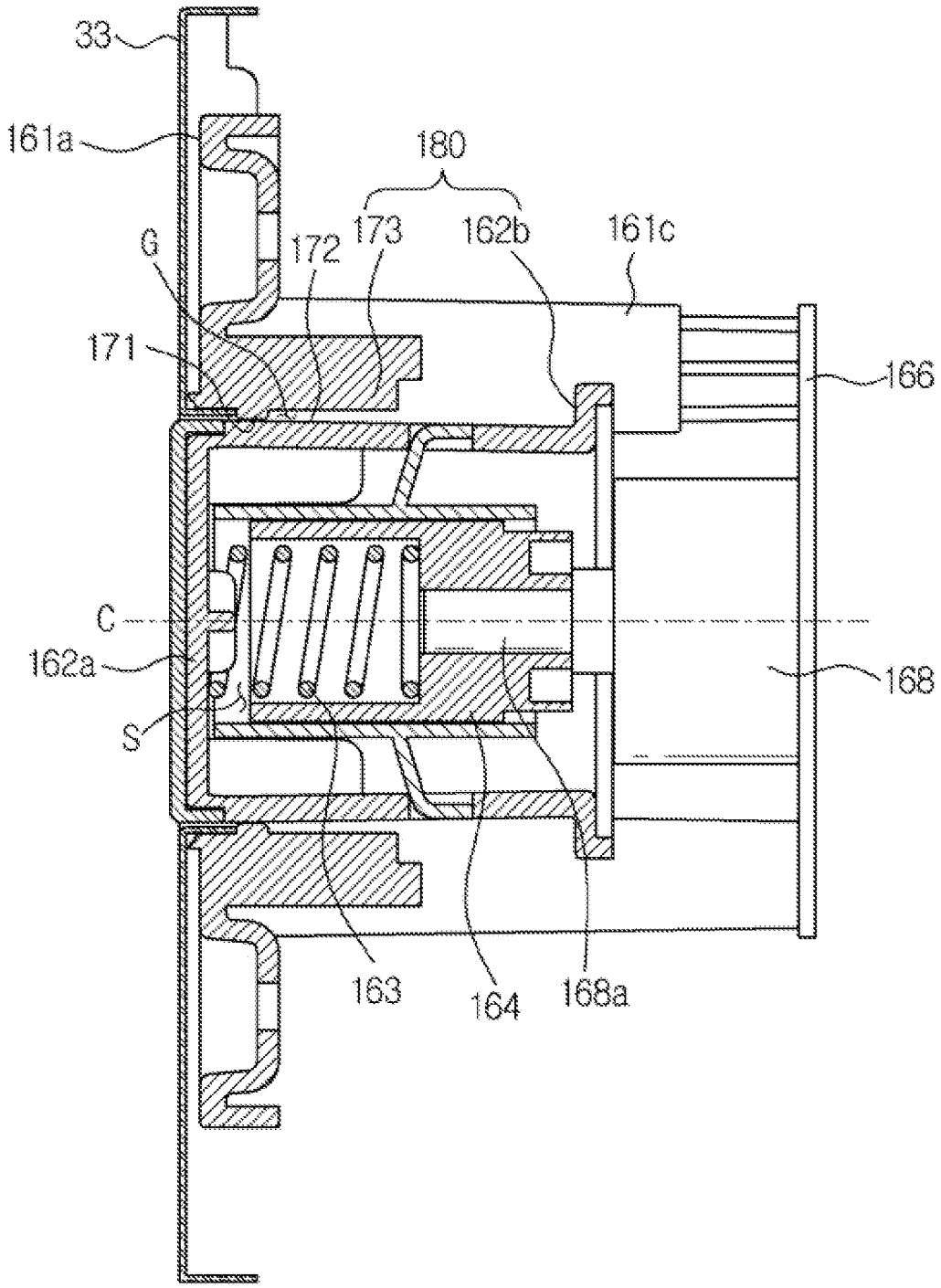
FIG. 7B is a cross sectional view of a pop-up apparatus in accordance with an embodiment, showing a knob disposed at a second position.

FIG. 6 is an exploded perspective view of a pop-up apparatus in accordance with an embodiment. FIG. 7A is a cross sectional view of a pop-up apparatus in accordance with an embodiment, showing a knob disposed at a first position. FIG. 7B is a cross sectional view of a pop-up apparatus in accordance with an embodiment, showing a knob disposed at a second position. The pop-up apparatus in accordance with the embodiment may be applied to various types of electronic products such as an oven, a washing machine and a refrigerator, and for the convenience of description, the following description will be made in relation to a pop-up apparatus applied to an oven as an example.

Referring to FIGS. 1, 6, 7A and 7B, the pop-up apparatus 160 includes a knob housing 161 installed at the front surface panel 33 of the oven 1 and coupled to a rear surface of the front surface panel 33, a knob 162 accommodated in the knob housing 161, a guide member 164 guiding a sliding movement of the knob 162, and an elastic member 163 disposed between the knob 162 and the guide member 164 to press the knob 162.

The knob housing 161 includes a coupling part 161*a* coupled to the rear surface of the front surface panel 33, a guide hole 161*b* formed through the coupling part 161*a* and allowing the knob 162 to move to a front side of the front surface panel 33, and a plurality of coupling bosses 161*c* extending to a rear side such that the circuit board 166 is coupled thereto.

The guide hole 161*b* includes at least one restriction rib 171 protruding from an inner circumferential surface of the guide hole 161*b*. The restriction rib 171 may be provided in one unit thereof formed in a ring shape along the inner circumferential surface of the guide hole 161*b*, or may be provided in plural units thereof disposed while being spaced apart from each other along the inner circumferential surface of the guide hole 161*b*. The restriction rib 171 restricts the tilting of the knob 162 accommodated in the knob housing 161. That is, in a case in which the knob 152 is tilted due to its own weight in a state of being accommodated in the knob housing 161, or tilted by being pressed by a link member (not shown) connecting the knob 152 to the guide member 164, the restriction rib 171 supports a side surface of the knob 162 in response to the tilting direction, thereby restricting the tilting of the knob 162. In addition, the restriction rib 171 prevents the inside of the pop-up apparatus 160 from being exposed through a gap G between the knob 162 and the guide hole 161*b* in a state that the knob 162 is accommodated in the knob housing 161, and enables the gap G between the knob 162 and the guide hole 161*b* to be constant in a circumferential direction of the knob 162, so that the external appearance of the product is improved while improving the reliability of the product.

In addition, the guide hole 161*b* includes at least one locking protrusion 173 protruding from the inner circumferential surface of the guide hole 161*b*. The locking protrusion 173 is disposed at a rear of the restriction rib 171, and makes contact with a flange part 162*b* of the knob 162, which is to be described later, to maintain the knob 162 at a first position in which the knob 162 protrudes to the front side of the front surface panel 33 while restricting an axial direction movement of the knob 162. The locking protrusion 174 may be provided in one unit thereof formed in a ring shape along the inner circumferential surface of the guide hole 161*b*, or may be provided in plural units thereof disposed while being spaced apart from each other along the inner circumferential surface of the guide hole 161*b*.

The knob 162 includes a body part 162*a* provided in a cylindrical shape having one side open, and a flange part 162*b* formed at one end of the body part 162*a*.

The body part 162*a* includes a cross section enlargement part 172 having a cross section of at least one section thereof getting enlarged while nearing the front side of the front surface panel 33 in a central axial direction C. Accordingly, when compared to a cross section of one end of the body part 162*a* adjacent to the flange part 162*b*, a cross section of the other end of the body part 162*a* protruding to the front side of the front surface panel 33 by passing through the front surface panel 33 is larger.

The cross section enlargement part 172 serves to prevent the interior of the pop-up apparatus 160 from being exposed through the gab B between the knob 162 and the guide hole 161*b* in a state that the knob 162 is accommodated in the knob housing 161, in cooperation with the restriction rib 171, and maintain the gap G between the knob 162 and the guide hole 161*b* constant along the circumferential direction of the knob 162.

The flange part 162*b* extends from one end of the knob 162 in a radial direction of the knob 162. The flange part 162*b* makes contact with the locking protrusion 173 to maintain the knob 162 at the first position in which the knob 162 protrudes to the front side of the front surface panel 33 while restricting the axial direction movement of the knob 162. The flange part 162*b* and the locking protrusion 173 form a stopper member 180.

A rotary encoder 168 is coupled to a front surface of the circuit board 166, and the guide member 164 is coupled to a rotary shaft 168*a* of the rotary encoder 168. The rotary encoder 168 detects the rotation direction, rotation speed, and rotation amount of the guide member 164 coupled to the rotary shaft 168*a*, and converts the detected rotation direction, rotation speed, and rotation amount to electric signals.

The guide member 164 is provided in a form of a cylinder having one end coupled to the rotary shaft 168*a* of the rotary encoder 168 and the other end provided in an open state. An outer circumferential surface of the guide member 164 makes contact with an inner circumferential surface of the knob 162 to guide the sliding movement of the knob 162, and if a rotating force is applied to the knob 152 in a state in which the knob 162 is disposed at the first position of protruding to the front side of the front surface panel 33, the guide member 164 rotates together with the knob 162, thereby rotating the rotary shaft 168*a* of the rotary encoder 168.

The elastic member 163 is provided between the knob 162 and the guide member 163. The elastic member 163 is disposed in a space S formed between the body part 162*a* of the knob 162 and the guide member 163 so as to be pressed, and serves to press the knob 162 to the front side.

The knob 162 may be provided so as to be disposed at the first position of protruding to the front side of the front surface panel 33 and a second position of being inserted to a rear side of the front surface panel 33. In a state that the knob 162 is disposed at the second position, if a user presses a front surface of the knob 162, the knob 162 protrudes to the front side so as to be disposed at the first position, and in a state that the knob 162 is disposed at the first position, if a user presses the front surface of the knob 162 again, the knob 162 is inserted to the rear side of the front surfaced panel 33 so as to be disposed at the second position.

The stopper member 180 including the flange part 162*b* and the locking protrusion 173 restricts the movement of the knob 162 such that the knob 162 is disposed at the first position. In addition, the flange part 162*b* and the locking protrusion 173 make a surface contact with each other, thereby restricting the shake of the knob 162 in a state of the knob 162 being disposed at the first position.

The restriction rib 171 restricts the tilting of the knob 162 in a state that the knob 162 is disposed at the second position. The restriction rib 171 and the cross section enlargement part 172 prevent the interior of the pop-up apparatus 160 from being exposed through the gap G between the knob 162 and the guide hole 161*b* in a state that the knob 162 is disposed at the second position, and enable the gap G between the knob 162 and the guide hole 161*b* to be constant in a circumferential direction of the knob 162, so that the external appearance of the product is improved while improving the reliability of the product.

Figure 8:
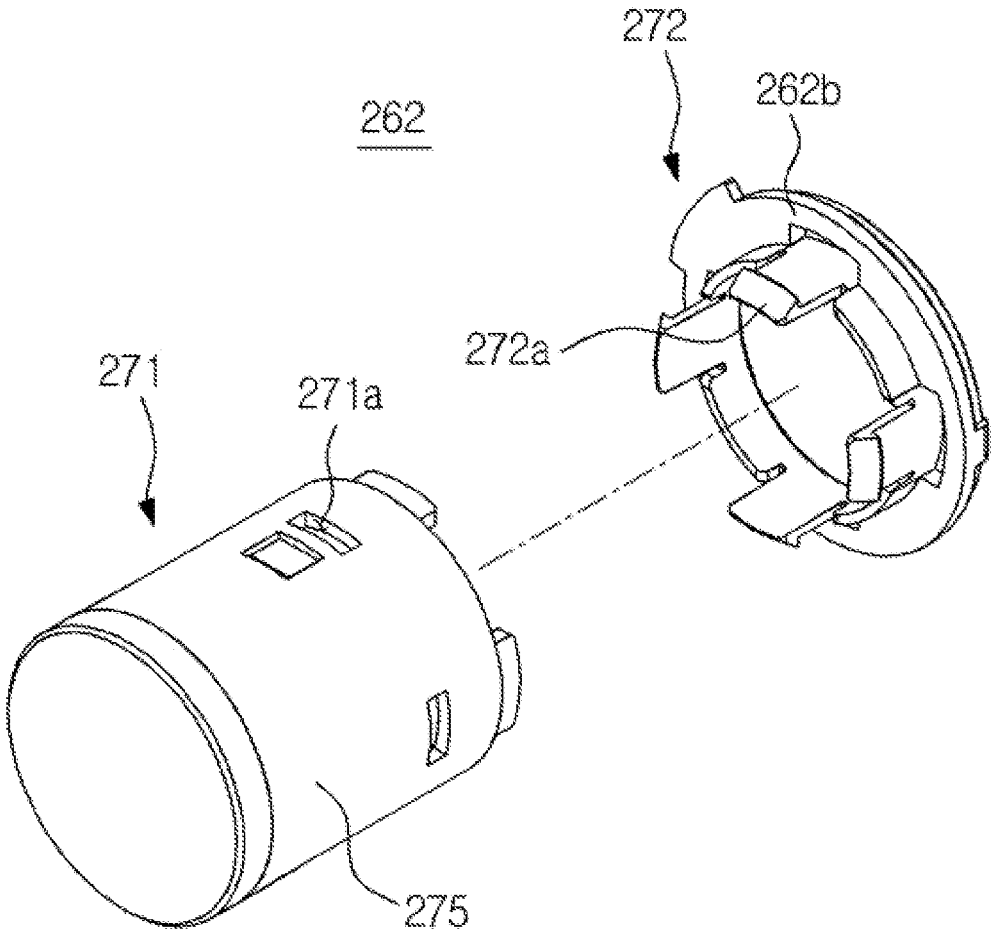
FIG. 8 is a perspective view of a knob of a pop-up apparatus in accordance with another embodiment.

FIG. 8 is a perspective view of a knob of a pop-up apparatus in accordance with another embodiment.

Referring to FIG. 8, a knob 262 in accordance with another embodiment includes a first portion 271 including a cross section enlargement part 275 and a second portion 272 including a flange part 262*b*.

The first portion 271 and the second portion 272 are coupled so as to be separated from each other. A plurality of hooks 272*a* protruding from one surface of the flange part 262*b* facing the first portion 271 are formed at one end of the second portion 272, and a plurality of hook holes 271*a* are formed at one end of the first portion 271 such that the plurality of hooks 272*a* are insertedly fixed to the plurality of hook holes 271*a*.

Since the knob 262 is composed of the first portion 271 provided so as to be separated from the second portion 272, the knob 262 is manufactured through an injection molding for the productivity. In a case in which the first portion 271 is not separated from the second portion 272, the cross section enlargement part 275 causes an inverse gradient in a direction opposite to a direction in which the knob 262 is pulled from a mold after being completed with curing in the mold, thereby having a difficulty of an operator in separating the knob 262 from the mold. In order to remove such a constraint, the first portion 271 and the second portion 272 are manufactured from different molds, respectively, and coupled to each other, thereby manufacturing the knob 262 including the cross section enlargement part 275 and the flange part 262*b* through an injection molding while improving the productivity.

As is apparent from the above description, the embodiments can control the volume of a fluid being discharged from the inside of the cooking chamber, so that the environment of the inside of the cooking chamber is maintained in a constant state at all times.

Although a few embodiments have been shown and described, it would be appreciated by those skilled in the art that changes may be made in these embodiments without departing from the principles and spirit of the disclosure, the scope of which is defined in the claims and their equivalents.

What is claimed is:

1. An oven comprising:

a cooking chamber to cook food;

a machine chamber disposed next to at least one side of the cooking chamber and accommodating an electronic component;

a cooling fan unit disposed at an inside of the machine chamber to cool the machine chamber; and a fluid passage guide communicating with an inside the cooking chamber and an inside of the cooling fan unit such that a fluid of the inside of the cooking chamber is introduced to the inside of the cooling fan unit, the fluid guide comprising:

a first fluid passage;

a second fluid passage; and a third fluid passage, wherein:

the cooling fan unit comprises:

a cooling fan configured to suck a fluid of the inside the machine chamber and blow the fluid;

a first outlet to allow the fluid blown by the cooling fan to be discharged to an outside of the cooling fan unit therethrough;

a flow control hole; and a second outlet to allow a fluid from the cooking chamber and the blown fluid introduced through the flow control hole and passing through the third fluid passage of the fluid passage guide to be discharged to the inside of the cooling fan unit through the second fluid passage, and the flow control hole to guide a controlled volume of the fluid discharged through the second outlet, by allowing introduction of a portion of the blown fluid of the inside of the cooling fan unit to the third fluid passage of the fluid passage guide, and the portion of the blown fluid is to be pushed from the cooling fan unit into the fluid passage guide to cause the fluid of the inside of the cooking chamber to be pulled from the cooking chamber into the first fluid passage of the fluid passage guide and discharged into the cooling fan unit where the cooling fan unit discharges the fluid outside the cooling fan unit.

2. The oven of claim 1, wherein the fluid passage guide comprises:

a first terminal communicating with the cooking chamber;

a second terminal communicating with the second outlet; and a third terminal communicating with the flow control hole.

3. The oven of claim 2, wherein:

a fluid introduced through the first terminal flows in the first fluid passage;

a fluid introduced through the third terminal flows in the third fluid passage; and a fluid introduced from the third fluid passage flows in the second fluid passage while joining the fluid introduced from the first fluid passage.

4. The oven of claim 1, wherein:

the cooling fan unit comprises an inclined surface formed by having at least one portion thereof inclined, and the second outlet is provided at one side of the inclined surface.

5. The oven of claim 4, wherein the second outlet is formed by slitting one portion of the inclined surface.

6. The oven of claim 1, wherein the fluid being discharged through the second outlet is discharged to the outside the cooling fan unit through the first outlet together with the blown fluid.

7. An oven comprising:

a cooking chamber to cook food;

a machine chamber accommodating an electronic component;

a housing disposed an inside of the machine chamber;

a cooling fan coupled to one end of the housing to suck a fluid of an outside the housing and blow the sucked fluid to an inside of the housing;

a fluid passage guide coupled to the cooking chamber and the housing, the fluid guide comprising:

a first fluid passage;

a second fluid passage; and a third fluid passage; and a plurality of communication holes formed through one surface of the housing such that the housing communicates with the second fluid passage and the third fluid passage in at least two different positions, wherein:

the plurality of communication holes comprises:

a first communication hole to guide a fluid of an inside of the fluid passage guide through the second passage so as to be discharged to an inside of the housing; and a second communication hole to guide a portion of the blown fluid of the inside of the housing so as to be introduced to the third passage of the fluid passage guide, and the portion of the blown fluid is to be pushed from the housing into the fluid passage guide to cause a fluid of the inside of the cooking chamber to be pulled from the cooking chamber into the first fluid passage of the fluid passage guide and discharged into the housing where the cooling fan discharges the fluid outside the oven.

8. The oven of claim 7, wherein at least one outlet is provided at other end of the housing to guide the fluid being introduced to the inside of the housing so as to be discharged to the outside the housing.

9. The oven of claim 8, wherein the housing comprises:

a converging part further comprising an inclined upper and lower surface, and a non-converging part including a parallel upper and lower surface and provided at one end thereof with the outlet.

10. The oven of claim 9, wherein the first communication hole is provided at the non-converging part.

11. The oven of claim 9, wherein the second communication hole is provided at the converging part.

12. The oven of claim 8, wherein the outlet is located between the cooking chamber and the machine chamber.

13. The oven of claim 7, wherein the first communication hole is formed by slitting one portion of the housing.

14. The oven of claim 13, wherein:

a fluid introduced from the cooking chamber flows along the first fluid passage;

a fluid introduced through the second communication hole flows along the third fluid passage;

the fluid introduced from the third fluid passage flows along the second fluid passage while joining the fluid introduced from the first fluid passage.

15. The oven of claim 14, wherein the flow flowing along the third fluid passage, after being introduced to the inside of the housing through the first communication hole, is discharged together with the fluid of the inside of the housing to the outside the housing through the outlet.

* * * * *